US007765921B2

(12) United States Patent
Vorreau et al.

(10) Patent No.: US 7,765,921 B2
(45) Date of Patent: Aug. 3, 2010

(54) CAGE BAR COMPRISING A SPACER, AND PRESSING DEVICE

(75) Inventors: Lothar Vorreau, Hamburg (DE); Günter Voss, Bardowick (DE)

(73) Assignee: Harburg-Freudenberger Maschinenbau GmbH, Hamburg (DE)

( * ) Notice: Subject to any disclaimer, the term of this patent is extended or adjusted under 35 U.S.C. 154(b) by 355 days.

(21) Appl. No.: 10/563,265

(22) PCT Filed: Jun. 14, 2004

(86) PCT No.: PCT/DE2004/001224

§ 371 (c)(1),
(2), (4) Date: Jun. 13, 2006

(87) PCT Pub. No.: WO2005/007393

PCT Pub. Date: Jan. 27, 2005

(65) Prior Publication Data

US 2007/0062858 A1 Mar. 22, 2007

(30) Foreign Application Priority Data

Jul. 3, 2003 (DE) ..... 103 29 952

(51) Int. Cl.
*B30B 9/26* (2006.01)

(52) U.S. Cl. ..... 100/129; 100/117

(58) Field of Classification Search ..... 100/117, 100/127, 128, 129, 145, 146, 147, 148, 149, 100/150; 210/350
See application file for complete search history.

(56) References Cited

U.S. PATENT DOCUMENTS 3,126,820 A 3/1964 Upton
3,191,521 A * 6/1965 Hiller ..... 100/37
3,373,680 A * 3/1968 Burnham ..... 100/129
4,289,065 A * 9/1981 Krebser ..... 100/129
4,355,589 A * 10/1982 Wetmore ..... 111/123

FOREIGN PATENT DOCUMENTS

| | | |
|---|---|---|
| DE | 298 11 871 | 11/1998 |
| DE | 201 04 282 | 3/2002 |
| EP | 0 956 942 | 11/1999 |

(Continued)

*Primary Examiner*—Jimmy T Nguyen
(74) *Attorney, Agent, or Firm*—Lucas & Mercanti, LLP; Klaus P. Stoffel

(57) ABSTRACT

A press cage bar for a device for expressing liquids, which is bounded by at least one pressing edge in the area of a wear surface of a hard layer and which, in the area of at least one lateral face of the body of the cage bar, has at least one spacer that is raised above the lateral face. The spacer is formed as a deposit weld on the lateral face of the cage bar and is provided with a certain bottom clearance from the underside of the cage bar, which is on the opposite side of the cage bar from the wear surface. The spacer extends along the lateral face no farther than to the hard layer. The extent of the spacer transversely to a longitudinal axis of the lateral face is greater than its extent in the direction of the longitudinal axis of the lateral face. The spacer has increasing thickness perpendicular to the lateral face in a direction extending from the hard layer towards the underside of the cage bar.

14 Claims, 4 Drawing Sheets

FOREIGN PATENT DOCUMENTS

| | | |
|---|---|---|
| EP | 1 240 997 | 9/2002 |
| FR | 703 870 | 1/1930 |
| FR | 2 029 032 | 10/1970 |
| GB | 1 182 470 | 2/1970 |
| GB | 2 292 111 | 2/1996 |
| WO | 03/076173 | 9/2003 |

* cited by examiner

CAGE BAR COMPRISING A SPACER, AND PRESSING DEVICE

TITLE OF THE INVENTION

The present application is a 371 of PCT/01224 filed Jun. 14, 2004, which claims priority of German application 103 29 952.1 filed Jul. 3, 2003.

BACKGROUND OF THE INVENTION

The invention concerns a press cage bar for a device for expressing liquids, which is bounded by at least one pressing edge in the area of a wear surface of a hard layer and which, in the area of at least one lateral face of the body of the cage bar, has at least one spacer that is raised above the lateral face.

The invention also concerns a device for expressing liquids, which has at least one press cage bar, which is bounded by at least one pressing edge in the area of a wear surface of a hard layer and which, in the area of at least one lateral face of the body of the cage bar, has at least one spacer that is raised above the lateral face.

Press cage bars of the aforementioned type are used as devices for expressing liquids from materials placed in the device. It can be used, for example, to express liquid substances from animal carcasses, offal, or oil-bearing fruits. The pressing devices have a drum-like design, and the press cage bars extend in the longitudinal direction of the drum. The substances to be processed are conveyed in this longitudinal direction. The residual materials are discharged in a practically moisture-free state from the inside of the drum at a drum discharge opening. The material is conveyed through the drum by a pressure and conveying screw.

During the conveyance of the materials through the drum, the liquids contained in the feed materials are expressed by the pressing operation between the contact surfaces of the screw channels of the conveying screw and the cage bars. To allow the expressed liquids to flow off, the cage bars are spaced apart to form drainage slits between them. To ensure optimum flow of the pressing operation, the cross-sectional area of the screw channel decreases from the inlet to the outlet.

The slits between the press cage bars are usually preset by spacers. In accordance with previously known embodiments, the spacers are, for example, placed manually as thin spacer plates; it is also already well known that thin spacer plates of this type can be joined with the cage bars by spot welding. However, due to the considerable forces that act during the pressing operation, these methods of installation of the spacers have the disadvantage that he spacers can be caused to slip, which can result in complete detachment of the cage bars and can cause the spacers to fall out. The use of spot welding also fails to provide adequate protection against slipping due to the danger of the welds tearing off.

In accordance with another well-known production method, the spacers are formed as single pieces with the cage bars and are produced by removing the excess material by milling or grinding. This production method prevents slipping and produces a high degree of stability of the overall device. However, in view of the large number of press cage bars that are used, this significantly increases production costs compared to the use of loose spacers.

It is already known from DE 298 11 871 U1 that cage bars can be provided with spacers that have increasing thickness starting from a wear surface and moving towards an underside of the body of the cage bar. In addition, the wear surface also has an inclined orientation.

It is known from DE 201 04 282 U1 that rivets with angled heads can be placed in a cage bar in such a way that they form spacers. The rivets have round-contoured rivet heads and are dimensioned in such a way that the rivet heads are spaced some distance from both the wear surface and an underside of the body of the cage bar.

U.S. Pat. No. 3,126,820 describes the installation of a plurality of cage bars in a pressing device. In this case, the spacers are provided with projecting stubs that fit into blind holes in the cage bars.

SUMMARY OF THE INVENTION

The objective of the present invention is to design a press cage bar of the aforementioned type in a way that is conducive to both a high degree of utility and economical manufacturing.

In accordance with the invention, this objective is achieved by forming the spacer as a deposit weld on the lateral face of the cage bar in such a way that the spacer is provided with a certain bottom clearance from the underside of the cage bar, which is on the opposite side of the cage bar from the wear surface; that it extends along the lateral face no farther than to the hard layer; that its extent transversely to a longitudinal axis of the lateral face is greater than its extent in the direction of the longitudinal axis of the lateral face; and that it has increasing thickness perpendicular to the lateral face in a direction extending from the hard layer towards the underside of the cage bar.

A further objective of the present invention is to design a device of the aforementioned type in such a way that a high degree of operating reliability is achieved at a favorable manufacturing cost.

In accordance with the invention, this objective is achieved by forming the spacer as a deposit weld on the lateral face of the cage bar in such a way that the spacer is provided with a certain bottom clearance from the underside of the cage bar, which is on the opposite side of the cage bar from the wear surface; that it extends along the lateral face no farther than to the hard layer; that its extent transversely to a longitudinal axis of the lateral face is greater than its extent in the direction of the longitudinal axis of the lateral face; and that it has increasing thickness perpendicular to the lateral face in a direction extending from the hard layer towards the underside of the cage bar.

A design that is inexpensive to manufacture and at the same time is highly functional is provided by the combination of the feature of a spacer realized as a deposit weld and the feature of the elongated formation of the deposit weld transversely to the longitudinal direction of the cage bar and by the clearance both between the spacer and the wear surface and between the spacer and the underside of the cage bar. The clearance between the spacer and the hard layer prevents the occurrence of negative effects on the material properties of the hard layer when the spacer is mounted. In particular, it is critical that local heating of the hard layer be prevented, since this can cause stresses, cracking or embrittlement. Furthermore, in the event of clogging or reduction of the cross section of the drainage channels formed between the spacers, the clearances that are provided allow the draining liquid to be conveyed in the area of an adjacent drainage channel. The term liquids is understood to include substances with flowable, pasty or dispersive consistencies.

In addition, the formation of the spacers as deposit welds produces a strong connection between the spacers and the body of the cage bar, so that the spacers cannot fall off or slip. Due to the increasing thickness of the spacers in the direction extending from the hard layer towards the underside of the cage bar, an angle of inclination of the spacers is produced that allows a plurality of spacers to be positioned with precise fitting along the inner contour of a press drum.

It is conducive to favorable flow behavior for the spacer to have top clearance from the hard layer.

Providing the end of the spacer that faces the hard layer with a rounded contour also contributes to low flow resistance.

Further optimization of the flow behavior can be obtained by providing the end of the spacer that faces away from the hard layer with a rounded contour.

An especially advantageous type of shaping consists in contouring the spacer essentially as an elongated oval.

Optimum mutual support of the cage bars can be achieved by grinding the surface of the spacer that faces away from the lateral face.

Adaptation to the usual directions of flow can be achieved if the longitudinal axis of the spacer extends essentially transversely to the longitudinal axis of the lateral face.

To ensure optimum support of the spacers, it is proposed that at least two spacers be arranged spaced apart on the lateral face.

A high-strength design is produced if the spacer is made of a material that contains chromium carbide.

Specific embodiments of the invention are illustrated schematically in the drawings.

DETAILED DESCRIPTION OF THE INVENTION

Figure 1:
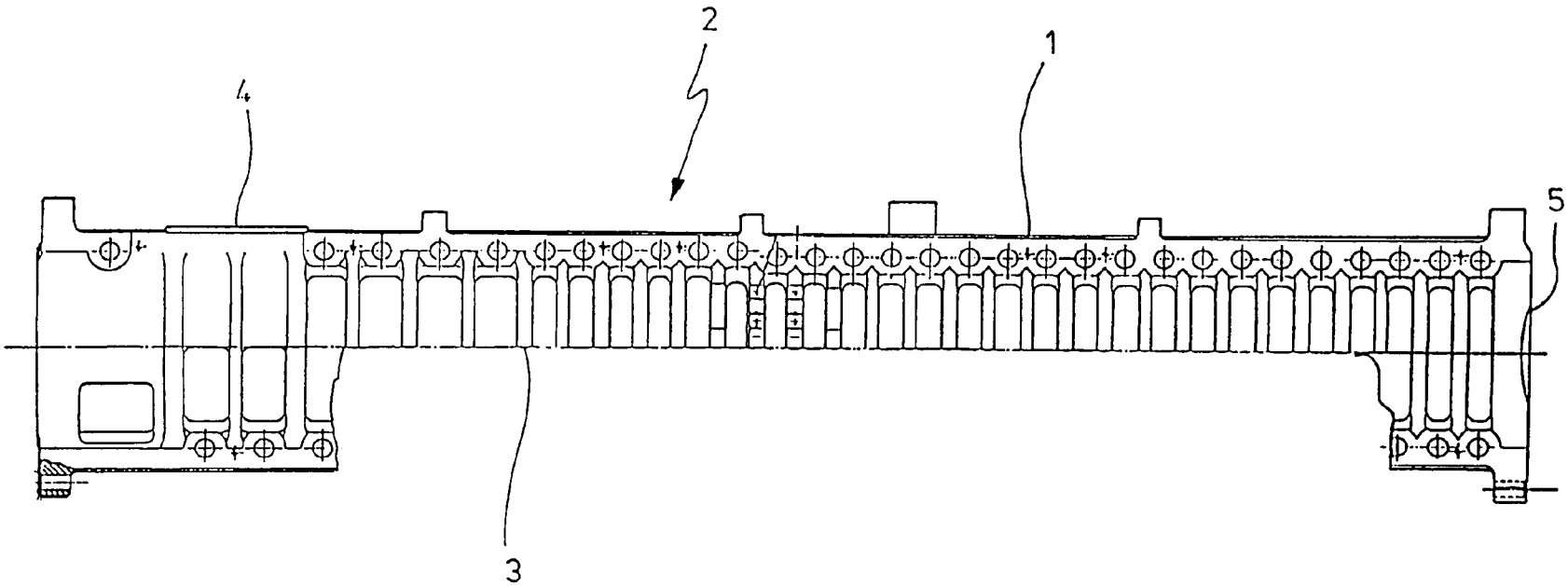
FIG. 1 shows a partially interrupted side view of a framework for the cage bars.

FIG. 1 shows a partially interrupted view of a framework (1) for cage bars of a pressing device (2) for expressing liquid substances from feed materials. The substances are conveyed along the longitudinal axis (3) of the drum from a material inlet (4) towards a dry substance outlet (5).

Figure 2:
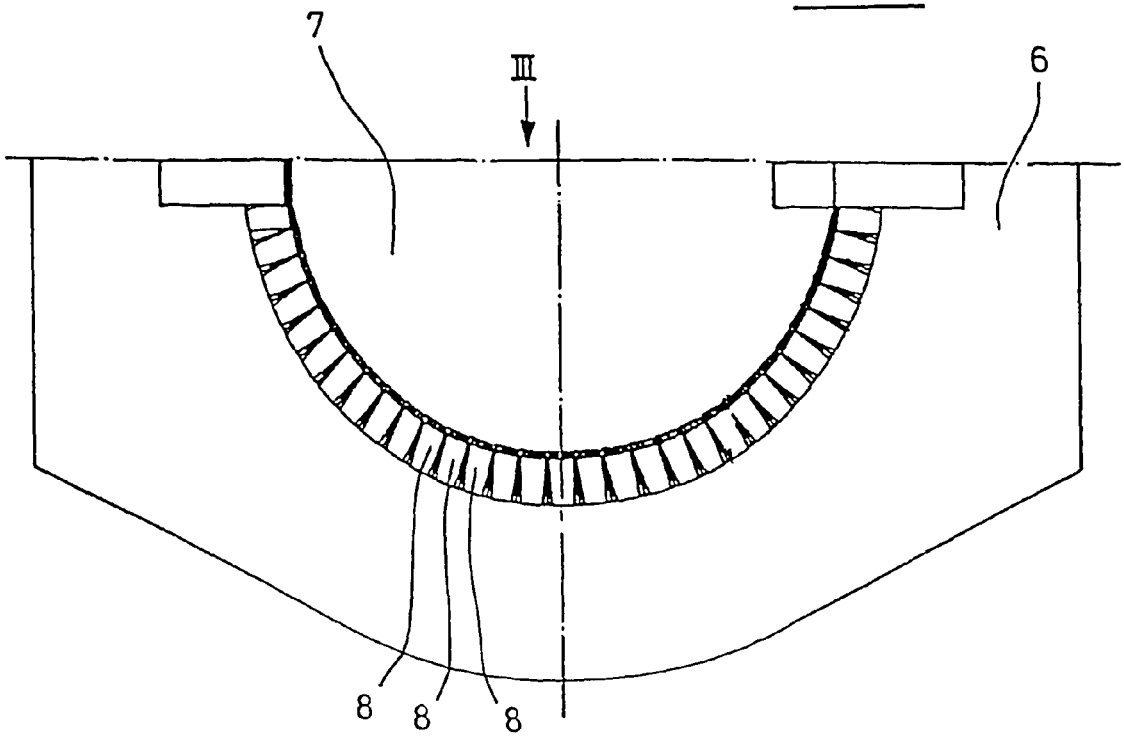
FIG. 2 shows a schematic view of a drum half of a pressing device with the cage bars inserted.

FIG. 2 shows a cross section through a drum half (6) of the pressing device (2). The drawing reveals that a plurality of cage bars (8) are arranged along a radial circumference of the drum interior (7).

Figure 3:
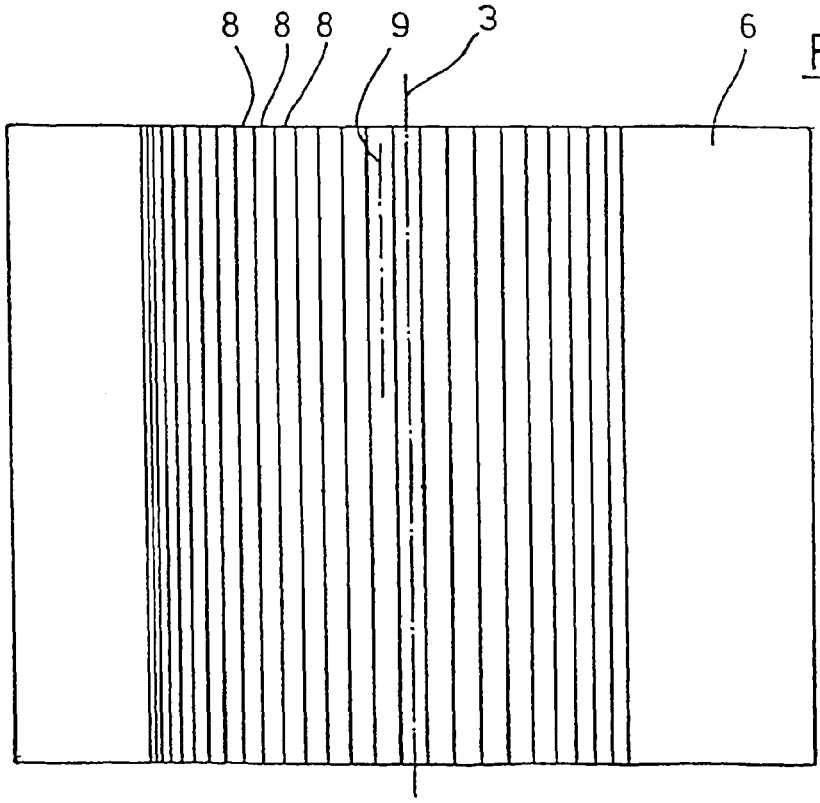
FIG. 3 shows a scaled-down view from viewing direction III in FIG. 2.

The view in FIG. 3 shows that the longitudinal axes (9) of the cage bars (8) extend essentially parallel to the longitudinal axis (3) of the drum. Both FIG. 2 and FIG. 3 show that the cage bars (8) are very closely arranged relative to one another.

Figure 4:
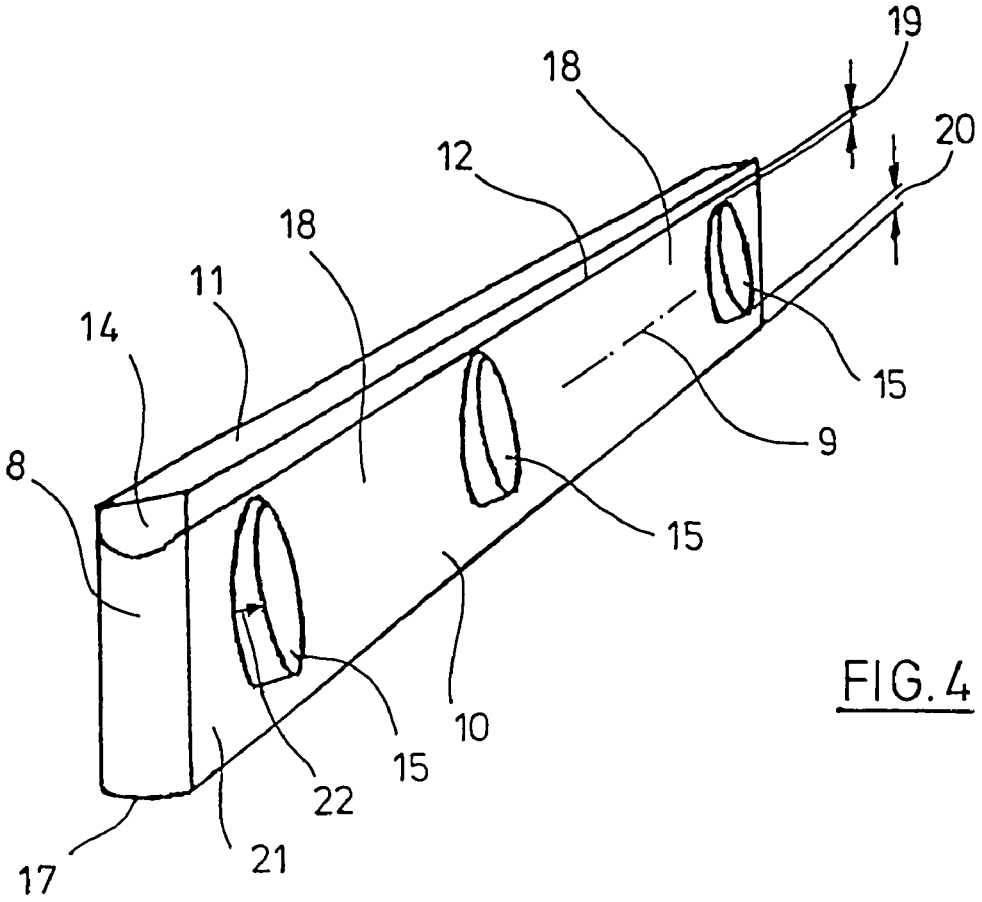
FIG. 4 shows an enlarged perspective view of a cage bar with spacers.
Figure 5:
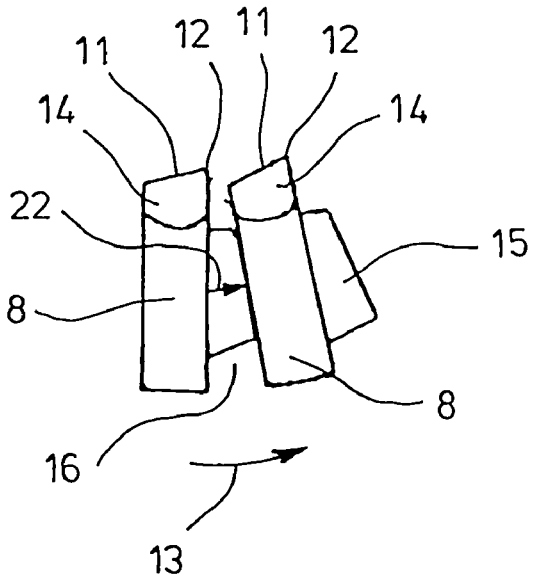
FIG. 5 shows two cage bars according to FIG. 4 arranged side by side.

The design of the cage bars (8) is further illustrated by the enlarged view in FIG. 4. The drawing shows that each cage bar (8) consists of a body (10) and a wear surface (11). The wear surface (11) is bounded by a pressing edge (12). As FIG. 5 shows, the wear surfaces (11) of adjacent cage bars (8) are inclined relative to each other in such a way that, in the direction of rotation (13), the pressing edge (12) of a following cage bar (8) projects above the wear surface (11) of the preceding cage bar (8). As a result, the interior (7) of the drum is bounded by a finely stepped surface. In particular, it is intended that the pressing edges (12) should be very sharp-edged.

In the illustrated embodiment, the pressing edge (12) is arranged in the area of a hard layer (14), which is welded onto the body (10) of the cage bar. In principle, however, it is possible to arrange the pressing edge (12) directly on a body (10) made of a hardened material.

FIG. 5 likewise illustrates that the cage bars (8) are supported relative to each other by spacers (15) and that a space (16) extends between each two adjacent cage bars (8), through which expressed liquid can emerge from the interior (7) of the drum. To assist the drainage of the expressed liquid, it is intended especially that the space (16) should be designed to widen in the direction from the pressing edge (12) towards the undersides (17) of the cage bars (8).

FIG. 4 shows that several spacers (15) are arranged spaced apart one after another in the direction of the longitudinal axis (9) of the bar. The spaces (16) are thus divided into space segments (18), which help the expressed liquid to drain off.

FIG. 4 illustrates a design of the spacers (5) in which the spacers (15) do not extend over the entire height of the body (10) of the cage bar. The partial extent over the height of the cage bars (8) that is illustrated in FIG. 4, with clearance from both the wear surface (11) and the underside (17) of the cage bar, results in especially effective drainage of the expressed liquid, since in the event of complete or partial clogging of individual space segments (18), liquid can overflow into adjacent space segments. Therefore, a local obstruction does not cause a significant increase in the total effective flow resistance.

The spacers (15) can be mounted on the body (10) of the cage bar by various methods. For example, the spacer (15) can be applied by deposit welding on the body (10) of the cage bar. In particular, using the hard material of the cage bars (8) from the area of the wear surface (11) or the hard layer (14) as the material for the spacers (15) contributes to a high degree of stability.

FIG. 4 also illustrates that a certain amount of top clearance (19) is provided between the spacers and the hard layer (14) and that a certain amount of bottom clearance (20) is provided between the spacers (15) and the underside (17) of the cage bar. The top clearance (19) ensures that even in the event of use-related wear of the hard layer (14), a sufficient distance from the wear surface (11) remains.

Perpendicular to the lateral face (21) of the cage bar (8), the spacers (15) have a thickness (22) that is smaller in the area of the ends of the spacers (15) that face the hard layer (14) than in the area of the ends of the spacers (15) that face the underside (17) of the cage bar. This allows the oblique mutual support of the cage bars (8) that is illustrated in FIG. 5.

In particular, it is intended that the spacers (15) be deposit-welded on the lateral faces (21) with an initially essentially constant thickness, and that the inclination then be produced by grinding according to the specific application geometry. This allows inexpensive production of a large number of standardized cage bars (8). The final geometry is then produced according to the specific application requirements shortly before delivery with comparatively little production expense. This helps achieve low production costs, small inventories, and short delivery times.

Figure 6:
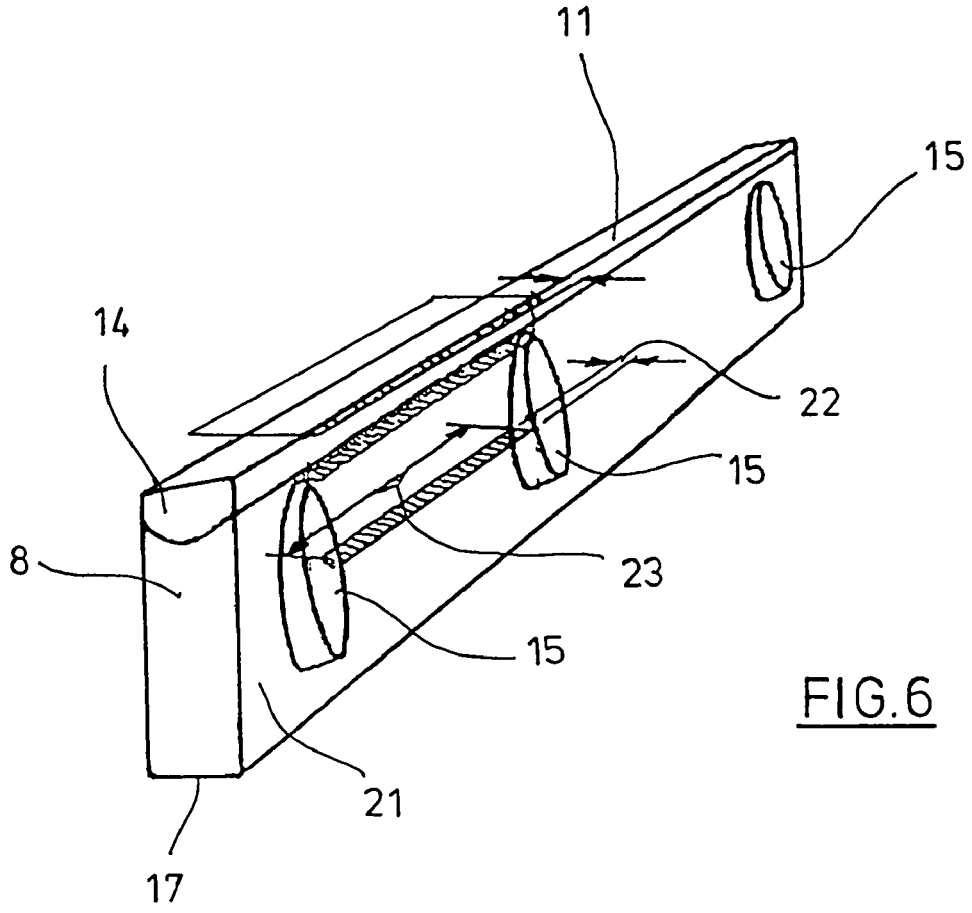
FIG. 6 shows a modified view of another cage bar.

The modified drawing in FIG. 6 again illustrates the thickness (22) of the spacers (15) and now further illustrates a spacer separation (23), by which the spatial dimensioning of the space segments (18) is determined. Between the spacers (15), the space segments (18) have cross-sectional areas that increase from the hard layer (14) towards the underside (17) of the cage bar.

Figure 7:
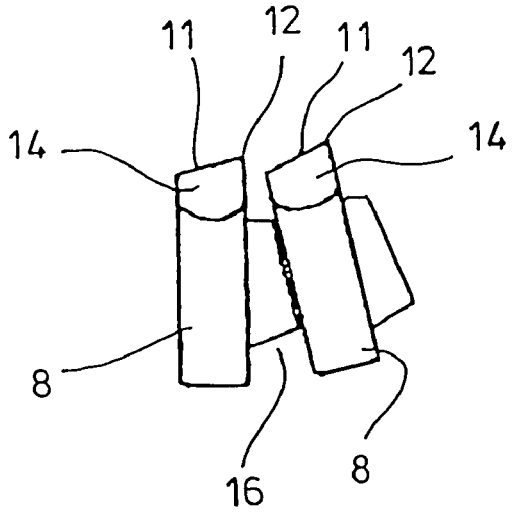
FIG. 7 shows two cage bars according to FIG. 6 arranged side by side.

A cross-sectional area of the cage bar (8) has an essentially rectangular shape and deviates from this rectangular shape only in the area of the inclination at the wear surface (11). In a slightly modified drawing, FIG. 7 is essentially the same as FIG. 5.

The invention claimed is:

1. Press cage bar for a device for expressing liquids, which is bounded by at least one pressing edge in the area of a wear surface of a hard layer and which, in the area of at least one lateral face of the body of the cage bar, has at least two spacers that are raised above the lateral face, wherein the body has a substantially rectangular cross section having an upper surface formed by the wear surface, the wear surface being angled and inclined such that pressing edge of the cage bar projects above a wear surface of a preceding cage in a direction of rotation, wherein each spacer (15) is formed as a deposit weld on the lateral face (21) of the cage bar (8); that each spacer (15) is provided with a certain bottom clearance (20) from the underside (17) of the cage bar (8), which is on the opposite side of the cage bar from the wear surface (11); that each spacer (15) extends along the lateral face (21) no farther than to the hard layer (14); that the extent of each spacer (15) transversely to a longitudinal axis (9) of the lateral face (21) is greater than its extent in the direction of the longitudinal axis (9) of the lateral face (21); and that each spacer (15) has increasing thickness (22) perpendicular to the lateral face (21) in a direction extending from the hard layer (14) towards the underside (17) of the cage bar (8), wherein the surface of each spacer (15) that faces away from the lateral face (21) is ground, wherein each spacer is shaped so that the spacing region between neighboring cage bars extends and increases from the hard layer in the direction of the underside, the spacers being spaced from one another along the lateral face (21).

2. Press cage bar in accordance with claim 1, wherein each spacer (15) has a certain amount of top clearance (19) from the hard layer (14).

3. Press cage bar in accordance with claim 1, wherein the end of each spacer (15) that faces the hard layer (14) has a rounded contour.

4. Press cage bar in accordance with claim 1, wherein the end of each spacer (15) that faces away from the hard layer (14) has a rounded contour.

5. Press cage bar in accordance with claim 1, wherein each spacer (15) has an essentially elongated oval shape.

6. Press cage bar in accordance with claim 1, wherein the longitudinal axis of each spacer (15) extends essentially transversely to the longitudinal axis of the lateral face (21).

7. Press cage bar in accordance with claim 1, wherein each spacer (15) is made of a material that contains chromium carbide.

8. Device for expressing liquids, which has at least one press cage bar, which is bounded by at least one pressing edge in the area of a wear surface and which, in the area of at least one lateral face of the body of the cage bar, has at least two spacers that are raised above the lateral face, wherein the body has a substantially rectangular cross section having an upper surface formed by the wear surface, the wear surface being angled and inclined such that the pressing edge of the cage bar projects above a wear surface of a preceding cage bar in a direction of rotation; wherein each spacer (15) is formed as a deposit weld on the lateral face (21) of the cage bar (8); that each spacer (15) is provided with a certain bottom clearance (20) from the underside (17) of the cage bar (8), which is on the opposite side of the cage bar from the wear surface (11); that each spacer (15) extends along the lateral face (21) no farther than to the hard layer (14); that the extent of each spacer (15) transversely to a longitudinal axis (9) of the lateral face (21) is greater than its extent in the direction of the longitudinal axis (9) of the lateral face (21); and that each spacer (15) has increasing thickness (22) perpendicular to the lateral face (21) in a direction extending from the hard layer (14) towards the underside (17) of the cage bar (8), wherein the surface of each spacer (15) that faces away from the lateral face (21) is ground, wherein the spacer is shaped so that the spacing region between neighboring cage bars extends and expands from the hard layer in the direction of the underside, the spacers being spaced from one another along the lateral face (21).

9. Device in accordance with claim 8, wherein each spacer (15) has a certain amount of top clearance (19) from the hard layer.

10. Device in accordance with claim 8, wherein the end of each spacer (15) that faces the hard layer (14) has a rounded contour.

11. Device in accordance with claim 8, wherein the end of each spacer (15) that faces away from the hard layer (14) has a rounded contour.

12. Device in accordance with claim 8, wherein each spacer (15) has an essentially elongated oval shape.

13. Device in accordance with claim 8, wherein the longitudinal axis of each spacer (15) extends essentially transversely to the longitudinal axis of the lateral face (21).

14. Device in accordance with claim 8, wherein each spacer (15) is made of a material that contains chromium carbide.

* * * * *